US006793445B1

(12) United States Patent
Charlton et al.

(10) Patent No.: US 6,793,445 B1
(45) Date of Patent: Sep. 21, 2004

(54) METHOD AND APPARATUS FOR INSERTION OF ROCK BOLTS

(76) Inventors: Paul Charlton, 359 Coal Point Road, Coal Point, NSW 2299 (AU); Daniel Flynn, Lot 211 Blackhill Rd, Black Hill, NSW 2322 (AU)

( * ) Notice: Subject to any disclaimer, the term of this patent is extended or adjusted under 35 U.S.C. 154(b) by 0 days.

(21) Appl. No.: 09/937,683

(22) PCT Filed: Mar. 31, 2000

(86) PCT No.: PCT/AU00/00285

§ 371 (c)(1),
(2), (4) Date: Jan. 24, 2002

(87) PCT Pub. No.: WO00/60215

PCT Pub. Date: Oct. 12, 2000

(30) Foreign Application Priority Data

Mar. 31, 1999 (AU) ..... PP9553

(51) Int. Cl.[7] ..... E21D 20/00

(52) U.S. Cl. ..... 405/259.5; 405/259.1; 405/288; 405/302.1; 405/303

(58) Field of Search ..... 405/259.1, 259.5, 405/288, 302.1, 303

(56) References Cited

U.S. PATENT DOCUMENTS 3,815,368 A * 6/1974 Turzillo ..... 405/259.5
4,289,427 A * 9/1981 Rolston ..... 405/259.5
4,420,277 A * 12/1983 Hibbard et al. ..... 405/259.5
4,655,644 A * 4/1987 Lane et al. ..... 405/259.5
5,044,832 A * 9/1991 Gruber ..... 405/259.5
5,374,140 A * 12/1994 Standish et al. ..... 405/259.5
5,653,557 A * 8/1997 Gruber ..... 405/259.5

FOREIGN PATENT DOCUMENTS

EP 0126046 A1 * 4/1984 ..... E21D/20/02

* cited by examiner

*Primary Examiner*—Heather Shackelford
*Assistant Examiner*—Lisa M. Saldano
(74) *Attorney, Agent, or Firm*—Shalom Wertsberger; Saltamar Innovations

(57) ABSTRACT

A drill head capable of attachment to a drilling machine for insertion of rock bolts into rock strata. The drill head comprising: a base block adapted to facilitate attachment to the drilling machine; driving spindle mechanism having a member at one end which receives a proximal end of a rock bolt including an internal cavity; an injection assembly including at least one internal passage for retaining a grouting compound. When the rock bolt is inserted in the member and when the injection assembly engages the member, the passage is in communication with the internal cavity in the rock bolt; whereupon the injection assembly operates to inject a predetermined quantity of the grouting compound into a bolt hole in the rock strata via the internal cavity of the bolt.

20 Claims, 7 Drawing Sheets

Fig 1a - f

BOLT FULLY INSTALLED
THE RIG RETRACTS AND THE BOLT HAS BEEN FASTENED IN THE ROOF.

METHOD AND APPARATUS FOR INSERTION OF ROCK BOLTS

BACKGROUND

The present invention relates to insertion of rock bolts used in applications such as but not limited to underground mining. More particularly, the invention relates to an automatic drilling and injection head and a method of use thereof for automatic installation of self drilling rock bolts thereafter secured by preselected anchoring compounds.

Rock bolts are commonly used as anchors for securing rock strata to prevent unwanted collapse during mining operations such as excavation and the like. They are a proven means of securing rock masses in underground excavations and road tunnelling which might otherwise be in danger of collapse. Efficient installation of rock bolts is a critical facet of mining operations and it is desirable that this non productive part of mining activities be done as speedily as possible.

The concept of rock bolting involves the installation of a bolt in a predrilled hole in rock whose length is longer and whose diameter is slightly larger than the diameter of the rock bolt inserted therein.

PRIOR ART

There are in existance a wide variety of rock bolts and drilling machines for insertion of said bolts. The drilling machines employ drill rods with a cutting tip or drill bit on the leading end of the drill rod. The drill bit is usually larger in diameter than the drill rod to ensure a hole diameter at least slightly larger than the diameter of the drill rod. In order to drill a hole, the drill rod is rotated and urged against the rock face to initiate penetration.

In accordance with conventional methodology, most drill rods use air or water as a flushing fluid to flush rock cuttings from the drill hole during drilling. The flushing fluid is normally pumped through a central hole in the drill rod exiting the cutting tip then flowing out of the drill hole between the sides of the drill rod and the rock bolt hole thereby removing the rock cuttings from the hole during the drilling operation. The hole flushing clears the hole to accommodate the anchoring compound which is normally inserted manually after drilling. Whilst all drills employ rotation and axial thrust some additionally use impact drilling for very hard rock. Drilling into softer rocks such as sandstone will generally only require rotation and thrust. Hole drilling speed is a function of the type of rock, drill bit material and configuration and axial force applied during drilling. After drilling is complete, rock bolts are inserted once the drill rod has been withdrawn. There are two broad categories of rock bolts which are differentiated by the manner of engagement between bolt and rock. Bolts in the first category rely on frictional engagement between the bolt and at least a portion of the wall of the pre-drilled bolt hole. Bolts in the second category rely for their anchorage on grouting between the rock wall and bolt. The grouting compound will either be chemical or cement based.

Friction bolts rely on expansion of an associated member such as a sleeve which is engaged for example by rotation of a nut after insertion of the bolt in its hole, whereupon the sleeve engages the wall tightly to resist unwanted withdrawal. Bolts of this type include expansion shell bolts, inflating bolts and split set bolts.

Grouted rock bolts rely entirely on the integrity of the grouting compound which is inserted into the bolt hole once the hole is drilled. Maximum engaging strength is not achieved until the grout has set and has formed a solid anchor around the rock. A typical grouting compound is polyester resin although other compounds are used.

The coal industry commonly uses grouted rock bolts using resin anchors. The resin is held in cartridges which are inserted into predrilled bolt holes prior to insertion of the bolt. The resin cartridges are filled with resin mastic and resin catalyst and are typically 500 mm to 1500 mm in length. They must be of a diameter smaller than the bolt hole to enable insertion.

According to conventional methodology the steps involved in insertion of a resin anchored rock bolt are as follows:

a) drilling a hole of a diameter which is larger than the diameter of a bolt to be inserted;
b) withdrawing the drill rod from the hole;
c) manually inserting the resin cartridge;
d) inserting the bolt into the hole such that the bolt engages the resin cartridge and urges it to the back of the hole;
e) rotating and advancing the rock bolt such that the bolt penetrates the cartridge causing mixing of the cartridge contents (mastic and catalyst);
f) urging the bolt to full penetration whilst continuing rotation of the bolt;
g) allowing resin to cure and harden; and
h) tightening a nut on the proximal exposed end of the bolt to securely engage said bolt.

Whilst the above described method, used in various forms over the past twenty years, results in effective anchorage of rock bolts in underground mining applications, the process described is labour intensive, time consuming and therefore costly and is susceptible to poor quality control. There has been a long felt want in the mining industry for more efficient installation of bolts of the type which rely on grouting for anchorage, to reduce the time and labour component disadvantages of the present methodology.

Attempts have been made to address the aforesaid problems in resin anchored bolt installations by using self drilling rock bolts of the type described in patent application PCT/A91/00503. One such attempt involved the use of self drilling hollow rock bolts to the obviate the step of pre-drilling followed by withdrawal of the drill prior to insertion of the bolt. The self drilling bit functions as a combined drill and bolt. During self drilling, the hole is flushed with water to expel rock debris until the bolt has reached maximum depth whereupon the fluid is turned off. A grouting compound is then inserted into the space between the bolt and hole wall until the available space is occupied by the anchoring compound which could be resin or cement grout. Cement grout has major advantages over resin in that it can be mixed in a machine then pumped into the rock bolt hole. As the curing time for the cement grout is typically several hours, it is proceedurally simple to mix and pump cement grout and flush hoses and the machine before curing. The major disadvantage of cement grouting is that the cement takes several hours to cure which is unacceptable in the coal industry. Resin anchored bolts have the advantage that the resin cures in about 20 seconds but this fast setting may cause problems of clogging in the resin a delivery and mixing system once the mastic and catalyst, which are initially separated, have thoroughly mixed.

INVENTION

The present invention seeks to ameliorate the aforesaid prior art disadvantages by providing a method and associated apparatus for installing and anchoring self drilling rock bolts using an improved resin delivery and mixing system. The present invention also seeks to provide a system for installation of self drilling bolts, quickly and efficiently without clogging of the reson and delivery system. According to one embodiment of the invention there is porvided a drilling head for attachment to a drilling machine wherein the drilling head has means for rotation thrust and feed of a rock bolt, means for water injection and an apparatus for resin injection.

More particularly, according to one embodiment, the invention comprises a drill head adapted for releasable attachment to a drilling apparatus, wherein the drill head includes means to receive a proximal end of a self drilling rock bolt having an internal cavity and further comprising means to enable injection through said internal cavity of resin grout such as a mastic and a catalyst, wherein said mastic and said catalyst whilst present in said drill head are separated until co injection into said internal cavity of said bolt, whereupon mixing of said mastic and catalyst occurs to form a resin in which said bolt anchors; wherein the resin is injected into said cavity until it exits an opening in a distal end of said bolt and fills a space between the exterior of said bolt and the wall of said hole.

It is one object of the invention to provide a drill head for adaption to a drilling machine which allows the normal actions of rotation, axial thrust, water or air injection as well as injection through a rock bolt of a grouting compound, it is a further object to provide an improved injection system for flushing rock cuttings during drilling.

In one broad form the present invention comprises a drill head capable of attachment to a drilling machine for insertion of rock bolts into rock strata; the drill head comprising; a base block including means to facilitate attachment to said drilling machine; means for driving a spindle having a member at one end which receives a proximal end of a rock bolt including an internal cavity: an injection assembly including at least one internal passage for retaining a grouting compound, wherein, when said rock bolt is inserted in said member and when said injection member engages said member, said at least one passage is in communication with said internal cavity in said rock bolt; whereupon said injection assembly operates to inject a predetermined quantity of said grouting compound into a bolt hole in said rock strata via said internal cavity of said bolt. Preferably the spindle is rotatable and said member which engages said proximal end of said rock bolt comprises a chuck. Upon rotation of said spindle said rock bolt also rotates. The drill head further comprising passages through which a flushing fluid flows and which are in fluid communication with said cavity in said rock bolt.

The injection assembly according to one embodiment does not rotate but is capable of axial extension and retraction independant of said spindle. The injection nozzle functions as a shut off valve to isolate said flushing fluid from said cavity and includes two concentric passages each of which contains a separate grouting material, wherein said passages are disposed so as to keep the grouting materials separate until said materials exit said passages and enter the internal cavity in the rock bolt whereupon they mix to form a grouting resin. The grouting resin exits the internal cavity of the bolt via a distal end of said bolt and fills a space between an outer surface of the bolt and a wall of a hole in which the bolt is placed.

The member for receiving said proximal end of said rock bolt includes a recess which includes a profile which conforms to and engages with a corresponding profile on said proximal end of said bolt to enable mutual rotation of said member with said rock bolt. The profile of said recess is hexagonal and receives a corresponding hexagonal external profile formed in said proximal end of said rock bolt. The rock bolt is self drilling.

The injection assembly is capable of movement between a retracted state in which water is capable of entering said cavity of said rock bolt during drilling and an extended state when drilling has ceased in which an end of said injection assembly engages an opening to said cavity thereby allowing the passage of a grouting material held in said injection assembly into said bolt hole via said cavity in said bolt. Preferably, the grouting materials include polyester resins, PVA and epoxy resins.

According to a further apparatus aspect, the present invention comprises:

a drill head capable of attachment to a drilling machine for insertion of rock bolts into rock strata;

the drill head comprising;

a base block including means to facilitate said attachment to said drilling machine;

drive means for driving a spindle having a member at one end which engages a proximal end of a rock bolt including an internal cavity;

an injection assembly including at least one internal passage for retaining a grouting compound, wherein, when said rock bolt is inserted in said member said at least one passage is in communication with said internal cavity in said rock bolt; whereupon said injection assembly operates to inject a predetermined quantity of said grouting compound into said internal cavity of said bolt. Preferably, the member in which the distal end of the rock bolt is placed is a female socket having a hexagonal internal profile which corresponds with a corresponding external hexagonal profile on said rock bolt.

Preferably, the drill head further comprises means enabling injection through passages therein of water into the bolt hole to evacuate rock debris form the hole during drilling.

According to a preferred embodiment, the injection assembly includes two concentric passages each of which contains a separate grouting material, wherein said passages are disposed so as to keep the grouting materials separate until the materials exit said passages and enter the internal cavity in said rock bolt whereupon they mix to complete the grouting resin.

Preferably, the grout is injected until it exits the internal cavity of the bolt via a distal end and fills a space between an outer surface of the bolt and the wall of the hole in which the bolt is placed.

In another broad form of the apparatus aspect, the present invention comprises;

a drill head capable of attachment to a drilling machine for insertion of rock bolts into rock strata;

the drill head comprising;

a base block including means to facilitate said attachment to said drilling machine;

drive means for driving a spindle having a member at one end which engages a proximal end of a rock bolt which includes an internal cavity;

an injection assembly including at least one internal passage for retaining a grouting compound, wherein, when said rock bolt is inserted in said member, said at least one passage is in communication with the internal cavity in said rock bolt; whereupon said injection assembly operates to inject a predetermined quantity of said grouting compound into said internal cavity of said bolt; wherein the drill head further comprises means enabling injection through passages therein of water into the bolt hole to evacuate rock debris from the hole: and wherein the injection assembly has two concentric passages each of which contains a separate grouting compound, wherein said passages are disposed so as to keep the grouting compounds separate until the compounds exit said passages and enter the internal cavity in said rock bolt whereupon they mix on contact to form a grouting resin.

Preferably, the grout exits the internal cavity of the bolt via a distal end and is injected until it fills a space between an outer surface of the bolt and the wall of the hole in which the bolt is placed.

In another broad form the present invention comprises;

a drill head capable of attachment to a drilling machine for insertion of a rock bolt into rock strata; the drill head including;

a sprocket for receiving an end of said rock bolt which includes an internal cavity, an injection assembly including a passage for retaining a grouting compound and which when said bolt engages said sprocket is placed in communication with said internal cavity of said bolt;

wherein the injection assembly injects said grouting compound into the internal cavity of said bolt at least until said compound exits said internal cavity of said bolt and engages a wall of a hole in which said bolt is inserted.

Preferably, the grouting compound is injected until it fills the space between the exterior of the bolt and the wall of the hole in which the bolt is inserted.

In the broadest form of the apparatus aspect the present invention comprises;

a drill head having an injection assembly adapted to enable injection of a grouting compound from a passage in the drill head and into a bolt hole via an internal cavity in a rock bolt which communicates with said passage when an end of said bolt engages said drill head such that said passage and said internal cavity are substantially in alignment.

In another broad form of the apparatus aspect the present invention comprises;

a self drilling rock bolt for insertion in a rock strata and adapted to engage a drilling head capable of attachment to a drilling machine; wherein the rock bolt comprises; a proximal end and a distal end and an internal cavity therebetween: the proximal end having a mating profile which engages a corresponding profiled member on said drilling machine enabling mutual rotation of said bolt and said member, the distal end including an opening to said cavity for receiving a grouting material delivered to said bolt from said head. Preferably, when said bolt engages said head, said cavity in said bolt is in general alignment with a cavity in said head containing said grouting material. According to a preferred embodiment, an opening in said proximal end of said bolt receives at least one grouting material which advances along said cavity until it exits said bolt via said at least one opening in said distal end. Preferably, two grouting materials are employed but it will be appreciated that more than two grouting materials could be mixed in the cavity prior to exiting via said at least one opening in said distal end.

In one broad form of the method aspect the present invention comprises:

a method of insertion of a self drilling rock bolt in a rock strata using a drilling machine to which is attached a drill head; wherein the method comprises the steps of;

a) placing said drilling machine in alignment with a location at which a bolt is to be inserted;

b) taking a rock bolt having an internal cavity;

c) engaging an end of the rock bolt with a support member on said drill head;

d) advancing the drill head such that a distal end of the bolt engages rock into which the bolt is to be inserted:

e) rotating the bolt under the action of drive means associated with said head and maintaining an axial force such that the bolt self drills a hole in said rock strata;

f) during drilling, flushing the hole with a fluid such as water to remove unwanted rock cuttings;

g) injecting a grouting compound from at least one passage in an injection assembly into the cavity in said bolt;

h) continuing said injection of said compound at least until said compound exits the cavity in said bolt via openings in said bolt and enters an opening in the bolt hole between the wall of said hole and the exterior of said bolt.

According to a preferred embodiment, the method comprises the further step of; prior to injecting the compound into the cavity in said bolt, advancing an injection nozzle into sealing engagement with a proximal end of said bolt thereby allowing direct communication between the passage in said head and the cavity in said bolt In another broad form of the method aspect the present invention comprises; a method of grouting a rock bolt inserted in a rock strata using a drilling machine incorporating a drilling head; wherein the method of grouting comprises the steps of;

a) after a rock bolt has been placed in situ, advancing an injecting nozzle of an injection assembly incorporated in said head until it reaches sealing engagement with a proximal end of the rockbolt, b) injecting a grouting compound from a passage in said injection assembly into an internal cavity in said bolt;

c) continuing said injection until the grouting compound exits said internal cavity of said bolt and fully occupies a space formed between the exterior of said bolt and the wall of said hole;

d) retracting said nozzle away from sealing engagement with said bolt.

BRIEF DESCRIPTION OF THE DRAWINGS

The present invention will now be described in more detail according to a preferred but non limiting embodiment and with reference to the accompanying illustrations wherein.

DETAILED DESCRIPTION

Drilling machines employ a variety of different systems to apply rotation and thrust to drill rods and usually have some form of drive chuck which can either be a screw thread, a square drive or hexagonal drive chuck which fits a matching screw, square or hexagonal section of the drill rod. In long hole drilling, where multiple drill rods are used it is necessary to attach several drill rods together and pass them through the drilling head on the drilling machine. In this application an offset drive head may be used where the drive head is hollow and is offset from the main drilling motor itself. The offset drive head is normally driven by a gear system or by a chain from the drill motor. A flushing system is employed to remove rock cuttings from the drilling operation at the drill tip. This can be achieved by pumping water or air through the drill rods and getting the water or air to flow back down the hole along the outside of the drill rods. For this purpose water or air may be used or a combination of both forming a spray mist to remove cuttings.

Figure 1:
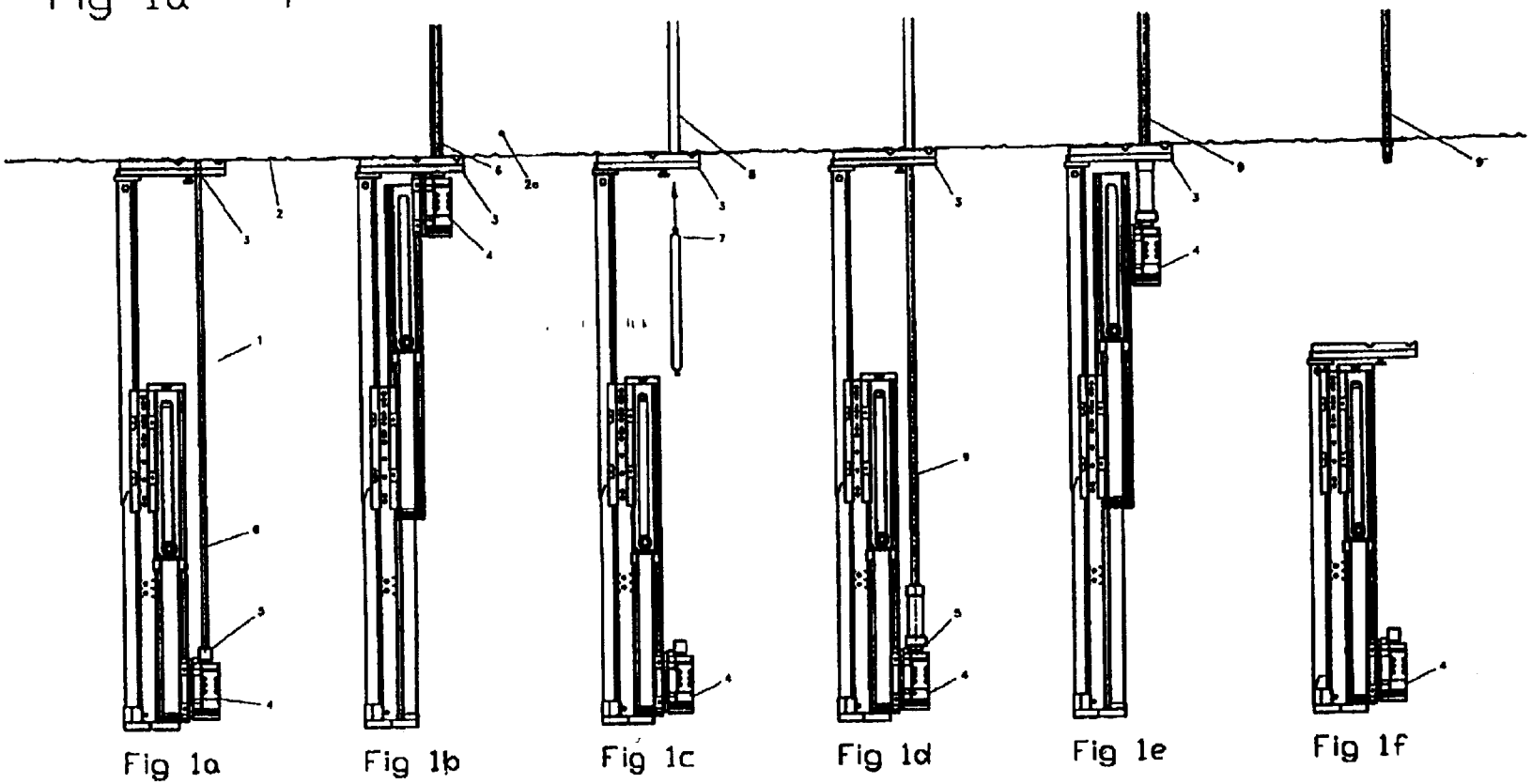
FIGS. 1 (*a*)–(*f*): show various steps for insertion of a rock bolt according to the prior art methodology.

Referring to FIGS. 1 (*a–f*) there is shown a drilling rig configured for the various stages of operation of installation of a rock bolt according to a prior art method. FIG. 1*a* shows drilling rig 1 engaging rock face 2 via plate 3. The rig comprises head 4 which includes a drill chuck 5 which receives steel drill 6. While drilling takes place, water is injected into the drill hole to evacuate unwanted rock cuttings. FIG. 1*b* shows the drill assembly of FIG. 1*a* wherein the drill steel has reached the limit of its travel and the bolt hole fully drilled through rock stratum 2*a*. At this point the water has been cut off and the drilling halted. FIG. 1*c* shows the drill steel fully removed and chemical sausage 7 prior to its installation in bolt hole 8. Once the chemical sausage has been inserted, a mixing dolly is installed as shown in FIG. 1*d* on chuck 5 of drilling rig 1 following which it is advanced to and urged into hole 8 as shown in FIG. 1*e* while it is rotated for a predetermined time in order to mix the chemical in sausage 7. Once bolt 9 is fully inserted, rotation is halted whereupon it is left for enough time to allow the resin to set. FIG. 1*e* shows the drilling machine with head 4 advanced to its extremity facilitating insertion of bolt 9 in rock stratum 2*a*. As shown in FIG. 1*f*, the drilling rig is then retracted leaving rock bolt 9 fully inserted. The above described prior art method of rock bolt installation is labour intensive and time consuming. On occasions, insertion of the chemical sausage can lead to delay as bunching might occur at the hole opening and there is also a delay in curing of the resin. This requires a delay in removing the drilling head as this functions to keep the bolt in position during curing.

Figure 2:
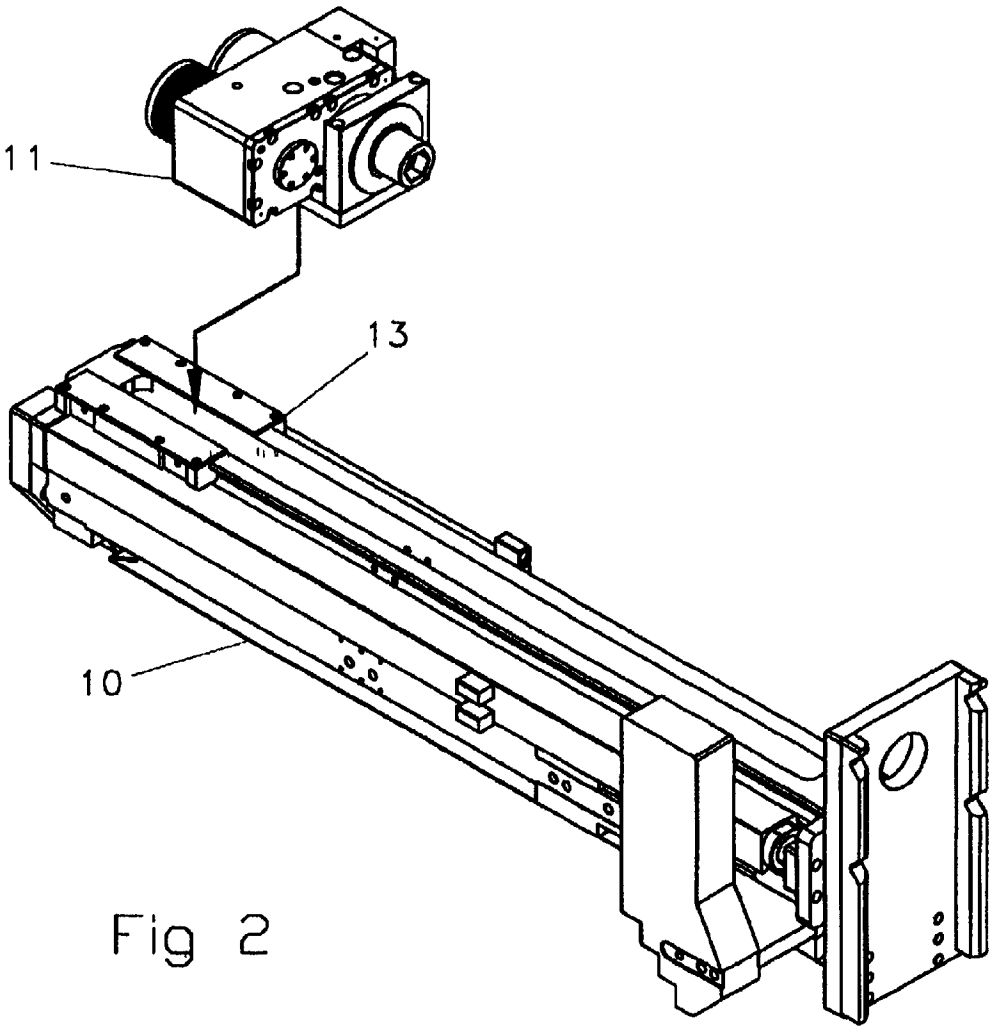
FIG. 2: shows an isometric exploded view of a rock bolting installation assembly with a drill head according to one embodiment of the invention.

FIG. 2 shows an exploded isometric view of a known roof bolter/drilling rig 10 including a drill head 11 according to a preferred embodiment of the invention. Drill head 11 may be connected to roof bolter 10 via engaging plates 13 by standard connection means. Thus, head 11 may be easily adapted to existing drilling equipment.

Figure 3:
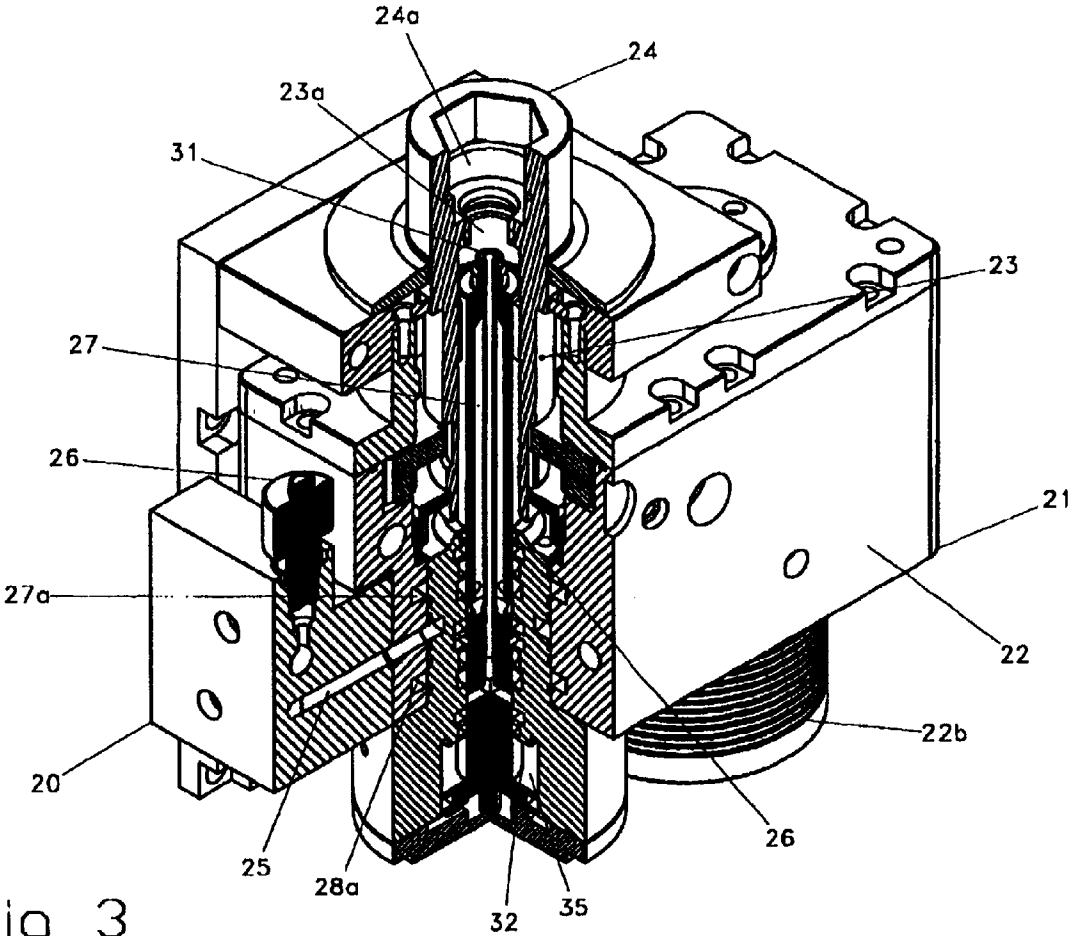
FIG. 3: shows an enlarged cut away view of a drill head according to a preferred embodiment of an apparatus aspect of the invention.

FIG. 3 shows an enlarged partially cut away view of a drill head 20 according to one embodiment of the apparatus aspect of the invention. Drill head 20 comprises housing block 21 including a gear box 22 which is connected to a drive motor incorporated in a drilling rig such as that shown in FIG. 2.

Gear box 22 further comprises drive assembly 22*a* and hydraulic motor 22*b*.

The head further comprises an offset drive spindle 23 including an integral drive chuck 24 which rotates responsive to operation of drive gears contained in gear box 22. Drive chuck 24 may be driven through either a gear system contained in gear box 22 or chain drive system (not shown). Housing block 21 includes a network of passageways 25 which deliver drilling fluid from a reservoir passage 26 then to a self drilling bolt 30 seated in recess opening 24*a* in chuck 24. Housing block 21 further includes passageways 27 and 28 which receive and deliver constituents of a grouting compound 29 (see FIG. 5) which is to be injected into passage 34 of rock bolt 30. Passageways 27 and 28 receive separate unmixed constituents of grouting compound 29 via feed ports 27*a* and 28.

Injection into bolt 30 is facilitated by means of an injection nozzle 31 which is capable of advancing axially in the direction of rock bolt 30 and retracting away from bolt 30 depending upon which stage of operation the drill head 20 is engaged in. Injection nozzle 31 may comprise one only or multiple passages which receive constituents of the grouting compound. In the case of multiple constituents it is preferable that these are isolated until such time as the constituents exit the nozzle and enter the internal passage 34 of bolt 30 whereupon the constituents will mix. The constituents mix and react to eventually set and when the mix exits passage 34 it fills the available space between the exterior surface of rock bolt 30 and the wall of the hole in the rock stratum in which the bolt is placed to secure the bolt in position.

Advancement and retraction is preferably effected by a hydraulic piston 32 located in chamber 35. Offset drive spindle 23 further includes a sealing arrangement comprising a seal 33 which prevents unwanted escape of water from chuck 24 during drilling but allows communication between an internal passage 34 in bolt 30 and fluid passages 25 when injection nozzle 31 is retracted away from chuck 24 and drilling is in progress.

In operation, the first stage of the drilling operation involves insertion of the self drilling rock bolt 30 into rock using a conventional drilling rig such as that described in FIG. 2.

During drilling, to ensure removal of debris from the drill hole, fluid such as water is pumped through passages 25 which empty the fluid into internal passage 34 of bolt 30 eventually exiting bolt 30 and entering a space between bolt 30 and the drilled bolt hole (not shown). The fluid passes over the leading end of injection nozzle 31. As the fluid exits the bolt hole it takes with it rock cuttings produced during drilling. During the drilling phase of operation, nozzle 31 is retracted away from opening 23*a* of drive spindle 23 and is inactive. Furthermore, the nozzle is independent of rotation of the spindle 23 such that it is free from rotation during the drilling operation precluding the need for special sealing requirements to prevent escape of resin during drilling.

Figure 4:
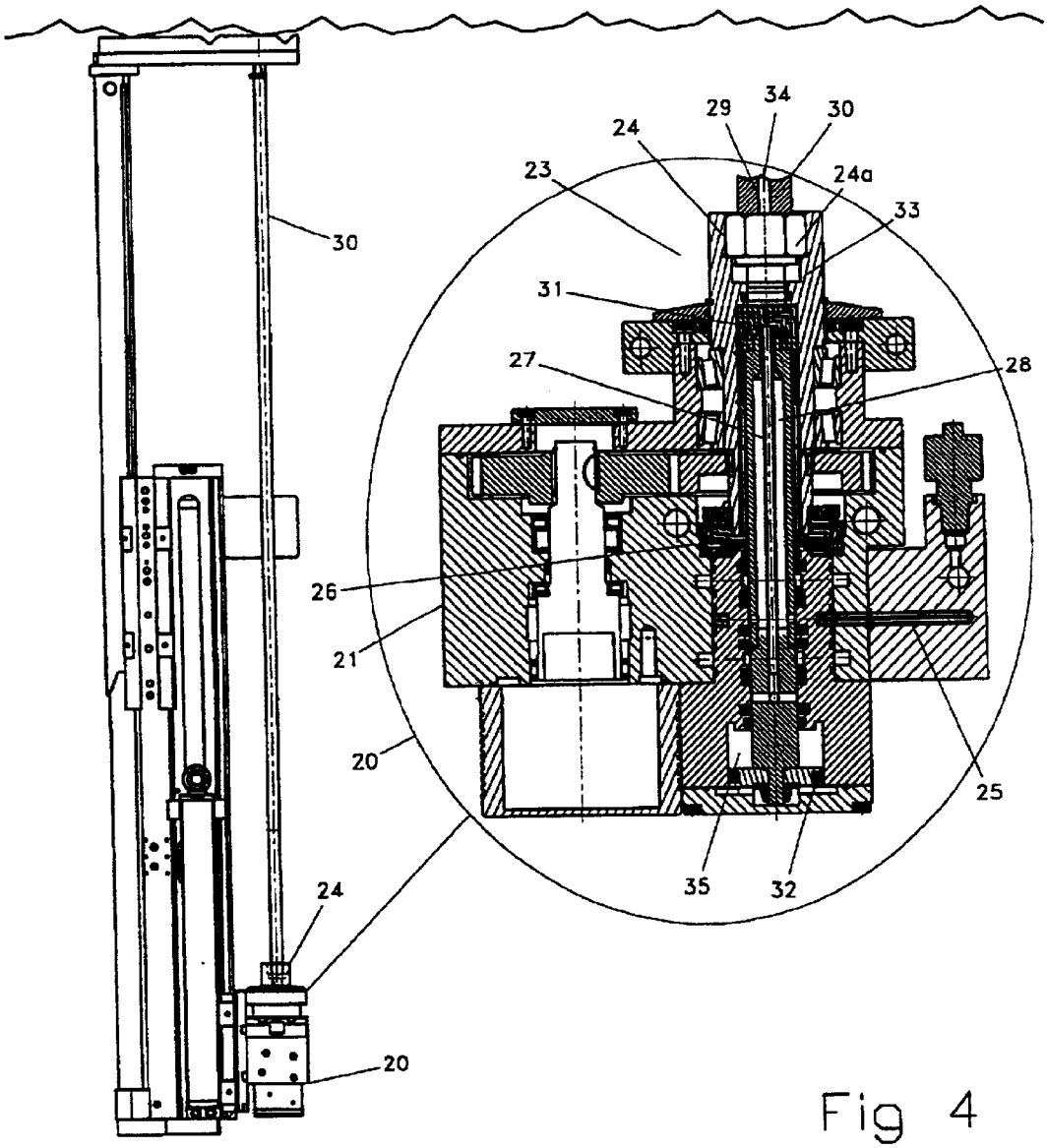
FIG. 4: shows an enlarged cross sectional view of the drill head of FIG. 3 adapted internally in the drilling configuration.

Once the hole is fully drilled, the rock bolting can be completed without first having to retract the head away from the rock face as occured in the prior art to facilitate insertion of the bolt. Referring to FIG. 4 there is shown a cross section of the head 20 of FIG. 3 with corresponding part numbering. FIG. 4 shows the drilling cycle in which the self drilling bolt 30 is rotated by its engagement to drive chuck 24 and the nozzle 31 retracted away from chuck 24 but allowing communication between passage 25 and internal passage 34 of bolt 30 thereby allowing free passage of fluid into passage 34 as previously described.

Figure 5:
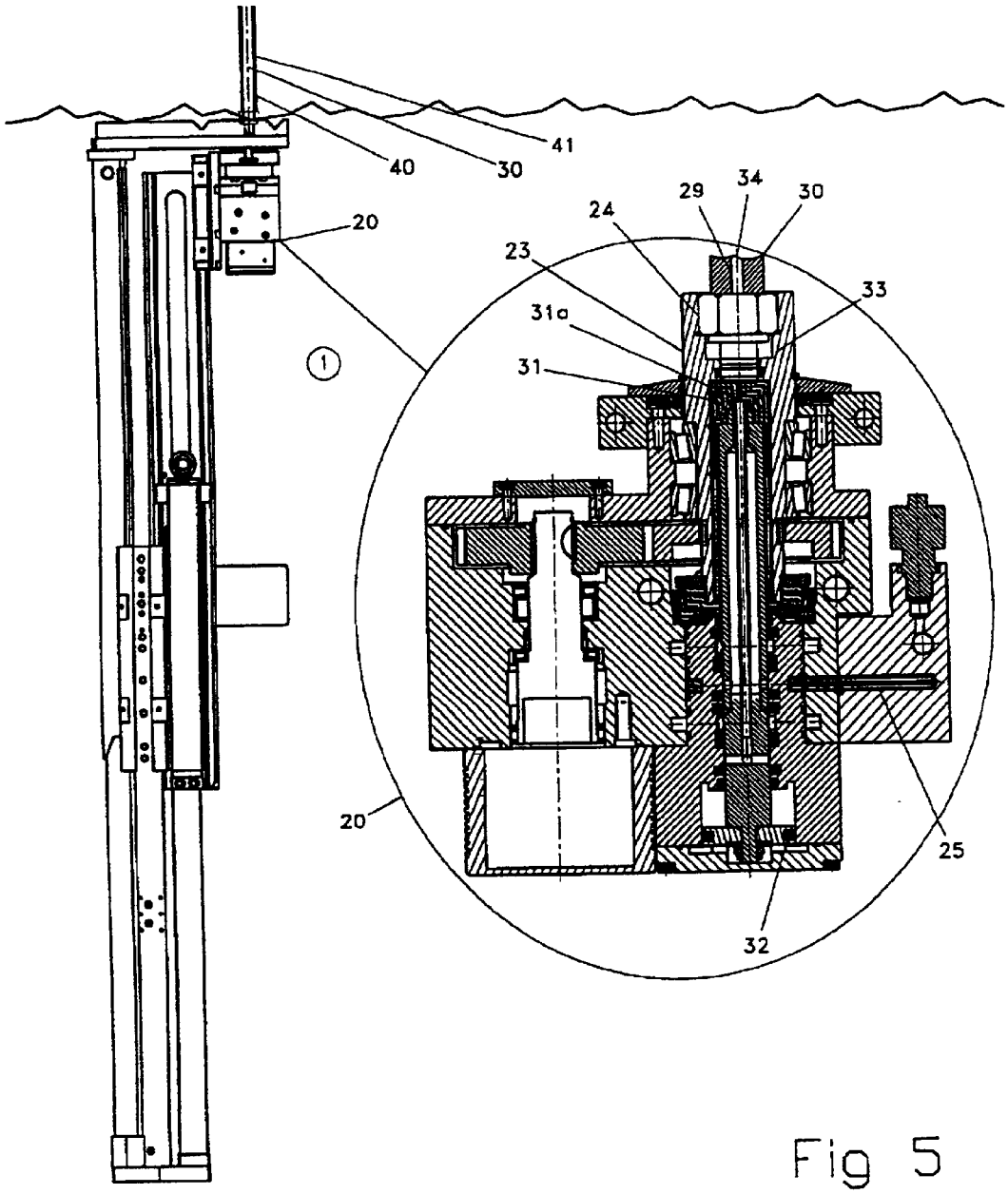
FIG. 5 shows the drill head of FIG. 3 adapted internally in the grouting configuration.

FIG. 5 shows head 20 this time with fluid supply from passage 25 turned off and nozzle 31 advanced into engagement with chuck 24 thereby allowing injection of grouting compound 29 into passage 34 of bolt 30. The leading end 31*a* of nozzle 31 seals passages 27 and 28 (see FIG. 4) from leakage such that their contents will discharge into passage 34 of bolt 30 forming grouting compound 29. Preferably, the grout is formed from a blend of resin mastic and resin catalyst which mix inside passage 34 of bolt 30 and which are excluded from contact while in respective passages 27 and 28 of injection nozzle 31. The resin compound is fast curing allowing quicker completion of bolt anchorage. The resin compound is injected into passage 34 of bolt 30 by piston 32 until it eventually exits openings 38 in bolt 30and fills a space between exterior of bolt surface 39 and wall surface 40 of bolt hole wall 41.

Figure 6:
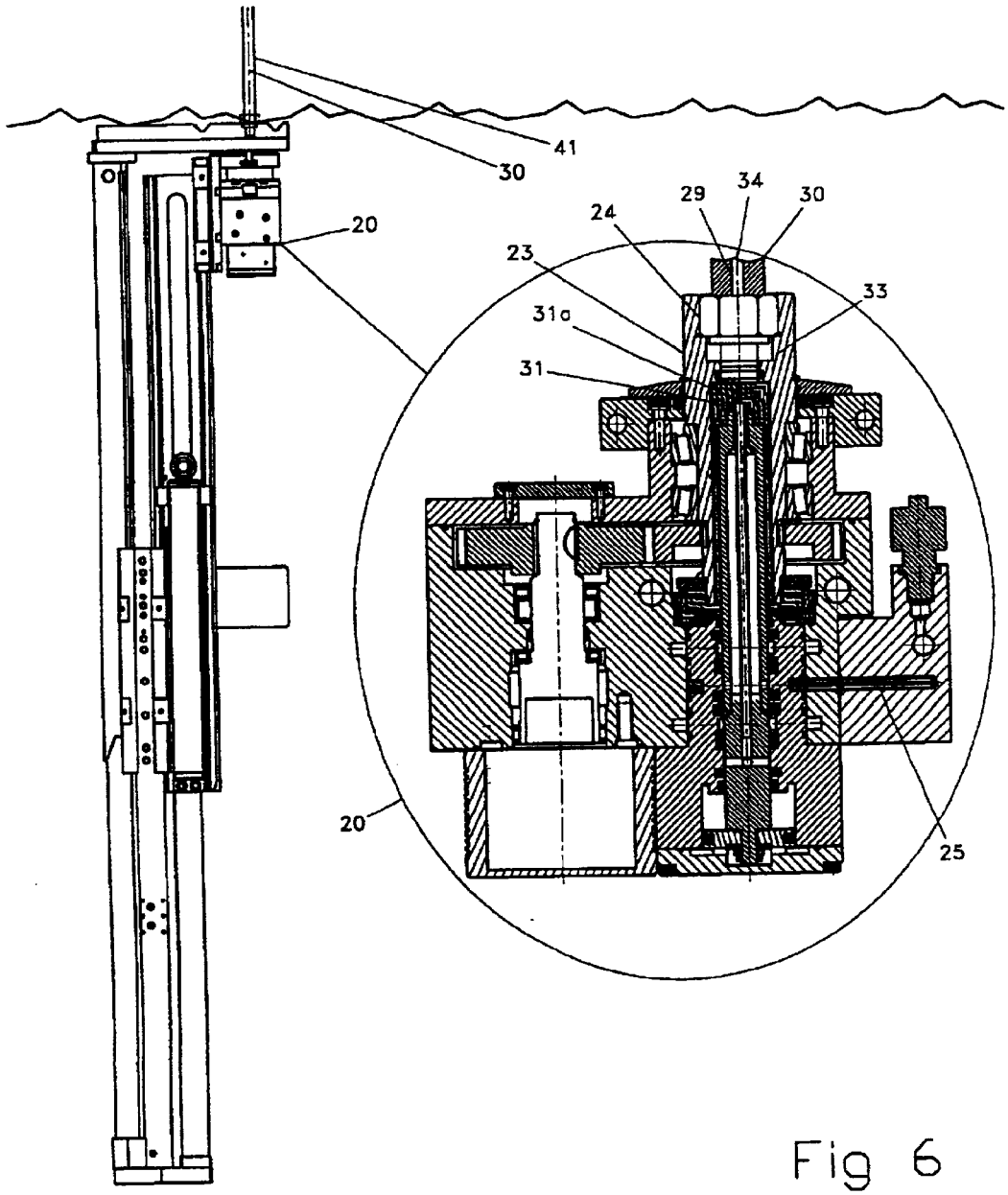
FIG. 6: shows the drill head of FIG. 3 adapted internally for water and injection shut off
Figure 7:
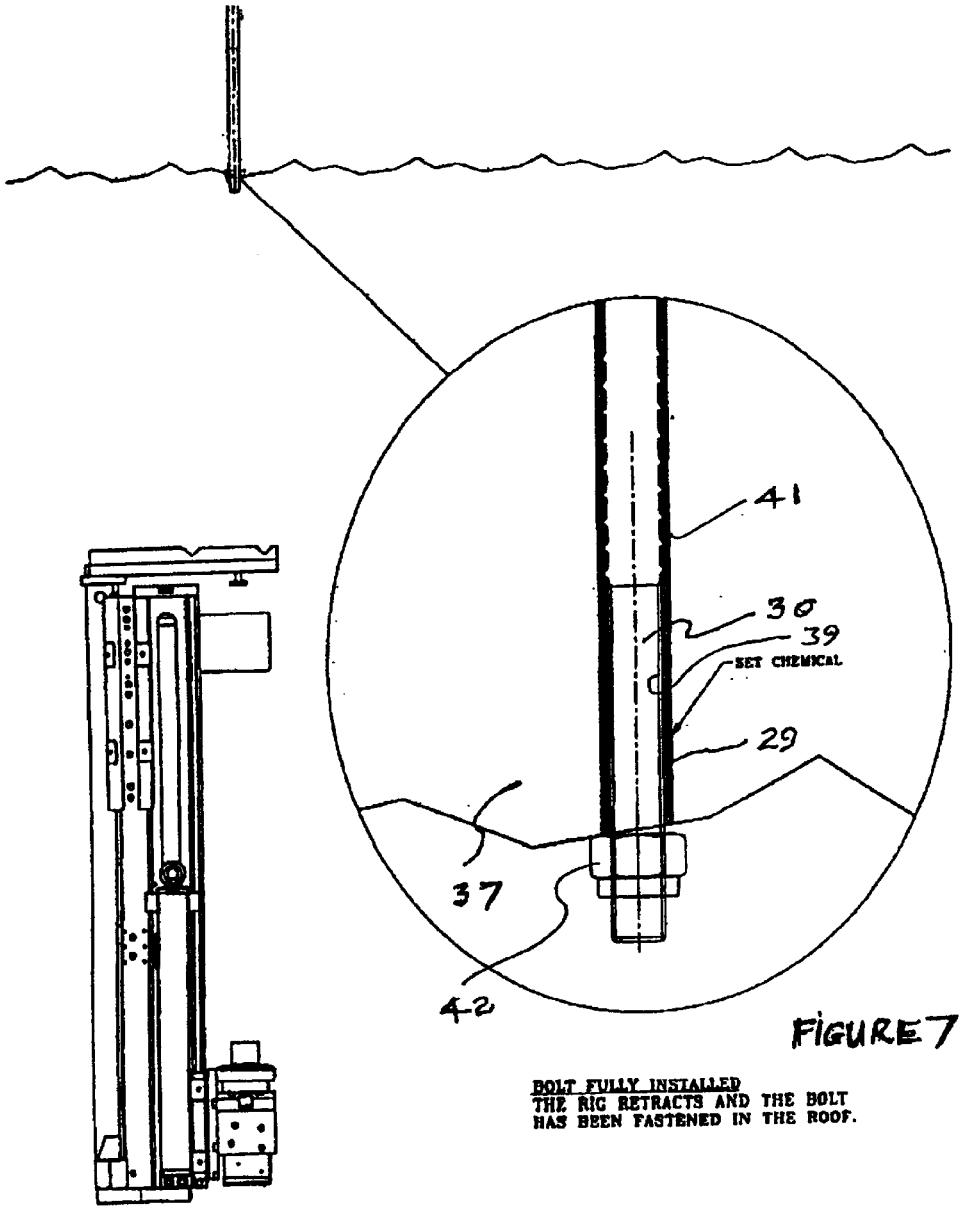
FIG. 7: shows a cross section of a bolt when fully installed.

FIG. 6 shows the final stage of the drilling operation with injection nozzle 31 fully retracted and flushing fluid turned off. At this stage, the spindle is rotated in the opposite direction to that for drilling whereupon engagement between a nut 42 (see FIG. 7) on bolt 30 is tightened. FIG. 7 shows an enlarged cross sectional view of bolt 30 inserted in a rock stratum 37 secured by grouting compound 29 between external surface 39 of bolt 30 and wall 41. An advantage of the invention described with reference to the above embodiment is the provision of separate grout injection and fluid flushing systems in the drill head. The injection nozzle 31 functions as a shut off valve such that in the fully retracted position, its internal passages are isolated from grout constituent passages 27 and 28.

The arrangement described above has numerous advantages over the prior art arrangements including: a minimum of moving parts, offset hollow drive spindle system, non rotating and self cleaning injection nozzle independent of the rotation of the spindle, use of the drilling fluid to clean the nozzle, the ability of the nozzle to act as a shut off valve for grout injection.

It will be recognised by persons skilled in the art that numerous variations and modification may be made to the invention as broadly described herein, such as but not limited to;

a) use of alternative grouting compounds such as polyester resins, PVA, epoxy resins and any single or multi component compound;

b) use of self drilled cable bolts, rods or tubes and indeed any form of rock bolt capable of use with the method and head described above, c) use of injection needles or syringes and any fitting adapted to seal against any rock bolt capable of use with the assembly described;

d) automation of the system using a Programmable Logic Computer to govern and regulate drilling cycles and more particularly injection cycles;

without departing from the overall spirit and scope of the invention.

What is claimed is:

1. A drill head capable of attachment to a drilling machine for insertion of rock bolts into rock strata; the drill head comprising;

a base block including means to facilitate attachment to said drilling machine;

drive means for rotating a spindle having a member at one end which receives a proximal end of a unitary rock bolt including an internal cavity; wherein the bolt rotates in conjunction with the spindle;

an injection assembly including a plurality of internal passages for retaining and delivering to the rock bolt individual materials of a grouting compound, the drill head further comprising passages through which a flushing fluid flows and which are in fluid communication with said internal cavity of said rock bolt;

wherein, said internal cavity in the rock bolt is in communication with the internal passages of the injection assembly so that when the proximal end of the rock bolt is inserted in the spindle, said injection assembly operates to inject from said internal passages in said injection assembly a predetermined quantity of said individual materials of a grouting compound into a bolt cavity in said rock strata via said internal cavity of said bolt and via a distal end of the bolt.

2. A drill head according to claim 1 wherein said spindle is rotatable and said member which engages said proximal end of said rock bolt comprises a chuck.

3. A drill head according to claim 1 wherein the injection assembly does not rotate and is capable of axial extension and retraction independent of said spindle to engage and disengage respectively from an opening to said cavity in said rock bolt.

4. A drill head according to claim 3 wherein, said injection assembly further comprises an injection nozzle which functions as a shut off valve to isolate said flushing fluid from said cavity of said rock bolt.

5. A drill head according to claim 1 wherein at least two of said internal passages are concentric.

6. A drill head according to claim 1 wherein grouting materials pass through an internal cavity of the bolt via a distal end of said bolt and fill a space between an outer surface of the bolt and a wall of a hole in which the bolt is placed.

7. A drill head according to claim 6 wherein the member for receiving said proximal end of said rock bolt includes a recess which includes a profile which conforms to and engages with a corresponding profile on said proximal end of said bolt to enable mutual rotation of said member with said rock bolt.

8. A drill head according to claim 7 wherein the profile of said recess is hexagonal and receives a corresponding hexagonal external profile formed in said proximal end of said rock bolt.

9. A drill head according to claim 8 wherein said rock bolt is self drilling.

10. A drill head according to claim 1 wherein said injection assembly is capable of movement between a retracted state in which flushing fluid is capable of entering said cavity of said rock bolt during drilling and an extended state when drilling has ceased in which an end of said injection assembly engages an opening to said cavity thereby allowing the passage of said individual materials of a grouting compound held in said injection assembly into said bolt hole via said cavity in said bolt.

11. A drill head according to claim 1 wherein the grouting materials is selected from a group consisting of polyester resins, PVA and epoxy resins.

12. A drill head capable of attachment to a drilling machine for insertion of rock bolts into rock strata; the drill head comprising; a base block including means to facilitate attachment to said drilling machine; drive means for driving a spindle having a member which engages a proximal end of a rock bolt having an internal cavity;

an injection assembly comprising at least two concentric passages, each of which adapted to contain and deliver separate materials of a grouting compound, wherein, when said rock bolt is inserted in said member, said at least two passage are in communication with the internal cavity in said rock bolt;

whereupon said injection assembly operates to inject a predetermined quantity of said separate materials of a grouting compound into said internal cavity of said bolt;

said passages are arranged so as to keep the separate materials of a grouting compound separated, until each of the separate materials exit said passages and enter the internal cavity in said rock bolt whereupon they mix to form a grouting compound prior to exiting from a distal end of said bolt; and, wherein the drill head further comprises means enabling injection through passages therein of a flushing fluid into a bolt hole cavity to evacuate rock debris from the hole during drilling.

13. A drill head according to claim 12 wherein the grout exits the internal cavity of the bolt via openings in a distal end and is injected until it fills a space between an outer surface of the bolt and the wall of the hole in which the bolt is placed.

14. A drill head capable of attachment to a drilling machine for insertion of a self drilling rock bolt into rock strata; wherein the drill head comprises:

an injection assembly adapted to enable injection of a grouting compound from concentric passages in a body of the drill head and into a bolt hole via an internal cavity in said rock bolt which communicates with said passage in said drill head when an end of said bolt engages said drill head such that said passage concentric passages and said internal cavity of the bolt are substantially in alignment.

15. A self drilling unitary rock bolt for insertion in a rock strata and adapted to engage a drilling head capable of attachment to a drilling machine; wherein the rock bolt comprises; a proximal end and a distal end and an internal cavity therebetween: the proximal end having a mating profile which engages a corresponding profiled member on said drilling machine enabling mutual rotation of said bolt and said member during insertion of said bolt, the bolt further including at or near said distal end at least one opening in communication with said cavity for discharging a grouting material delivered to said bolt from concentric passages in said drilling head having a common central axis with said internal cavity of said bolt.

16. A self drilling rock bolt according to claim 15 wherein an opening in said proximal end of said bolt receives the grouting material which advances along said cavity until it exits said bolt via said at least one opening in said distal end.

17. A self drilling rock bolt according to claim 16 wherein two grouting materials are discharged from the drilling head into said internal cavity in said bolt such that the two materials mix after exiting said concentric passages.

18. A method of insertion of a self drilling rock bolt in a rock strata using a drilling machine to which is attached a drill head; wherein the method comprises the steps of;

a) placing said drilling machine in alignment with a location at which a rock bolt is to be inserted;

b) taking a rock bolt having an internal cavity;

c) engaging a proximal end of the rock bolt with a support member on said drill head;

d) advancing the drill head such that a distal end of the bolt engages rock into which the bolt is to be inserted;

e) rotating the bolt under the action of drive means associated with said head and maintaining an axial force such that the bolt self drills a hole in said rock strata;

f) during drilling, flushing the hole via the internal cavity of the bolt with a flushing fluid to remove unwanted rock cuttings;

g) injecting into said internal cavity separate materials of a grouting compound from concentric passages in the head, the passages having a common axis with the internal cavity of the rock bolt;

h) allowing said grouting materials to mix to form a grouting compound;

i) continuing said injection of said grouting compound at least until said compound exits the internal cavity in said bolt and enters an opening in the bolt hole between the wall of said hole and an exterior surface of said bolt.

19. A method according to claim 18 comprising the further step; prior to injecting the compound into the cavity in said bolt, of advancing an injection nozzle into sealing engagement with a proximal end of said bolt thereby allowing direct communication between the passage in said head and the cavity in said bolt.

20. A method according to claim 19 wherein said passages are in an injection assembly which delivers said separate materials of a grouting compound.

* * * * *